US006425954B1

(12) United States Patent
Usui

(10) Patent No.: US 6,425,954 B1
(45) Date of Patent: Jul. 30, 2002

(54) HOLE PROCESSING APPARATUS AND METHOD THEREOF AND DYNAMIC PRESSURE BEARINGS CLEANING METHOD

(75) Inventor: Motonori Usui, Nagano (JP)

(73) Assignee: Kabushiki Kaisha Sankyo Seiki Seisakusho, Nagano (JP)

( * ) Notice: Subject to any disclaimer, the term of this patent is extended or adjusted under 35 U.S.C. 154(b) by 0 days.

(21) Appl. No.: 09/991,903

(22) Filed: Nov. 26, 2001

Related U.S. Application Data

(62) Division of application No. 09/476,993, filed on Jan. 4, 2000, now Pat. No. 6,336,976.

(30) Foreign Application Priority Data

Jan. 4, 1999 (JP) ..... 11-000044
Jan. 4, 1999 (JP) ..... 11-000046

(51) Int. Cl.[7] ..... B08B 3/12

(52) U.S. Cl. ..... 134/1; 134/22.1; 134/23; 134/25.1; 134/166 R; 134/184

(58) Field of Search ..... 134/1, 22.1, 23, 134/25.1, 166 R, 184

(56) References Cited

U.S. PATENT DOCUMENTS 4,561,902 A 12/1985 Lee ..... 134/1
4,789,405 A * 12/1988 Blasing et al. ..... 134/1

FOREIGN PATENT DOCUMENTS

| | | | | |
|---|---|---|---|---|
| DE | 268291 A1 | | 5/1989 | |
| JP | 62182699 | * | 2/1986 | ..... G21F/1/00 |
| JP | 03243800 | * | 10/1991 | ..... C25F/3/16 |
| JP | 8 71889 | | 3/1996 | |
| SU | 85-061289 | | 8/1984 | |

* cited by examiner

*Primary Examiner*—Randy Gulakowski
*Assistant Examiner*—M. Kornakov
(74) *Attorney, Agent, or Firm*—Sughrue Mion, PLLC

(57) ABSTRACT

An apparatus for processing holes includes processing device for providing ultrasonic cleaning process to an inner wall of a hole formed on a work piece, and for providing electrolytic cleaning process to said hole, a cleaning tank for storing a cleaning fluid, which is used as a processing fluid for ultrasonic processing and a processing fluid for electrolytic processing, said work piece being immersed in said cleaning fluid, a horn electrode tool serving as a horn tool for said ultrasonic processing means and an electrode tool for said electrolytic processing means, and support device supporting said horn electrode tool movable forward or backward in relation to said hole formed on said work piece in said cleaning tank.

15 Claims, 7 Drawing Sheets

HOLE PROCESSING APPARATUS AND METHOD THEREOF AND DYNAMIC PRESSURE BEARINGS CLEANING METHOD

This is a divisional of application Ser. No. 09/476,993 filed Jan. 4, 2000; the disclosure of which is incorporated herein by reference, now U.S. Pat. No. 6,336,976.

BACKGROUND OF INVENTION

1. Field of the invention

The present invention relates to apparatus and method for applying a cleaning process to a holes which formed on a work piece (an objet to be processed), and to cleaning method for dynamic pressure bearings.

2. Related art

Usually, swarf and process particles (metal chips), as well as burr, are found on the inner wall and the edge surface of a hole right after forming the hole on a work piece. When the metal chips and the burr need to be removed, in general, brush 1 as shown in FIG. 9 is employed. Brush 1 is rotated and inserted in hole 3 formed on work piece 2 in the axis direction thereof; then, the brush 1 is carried out the reciprocated movement for a plurality of times therein to clean the inner wall of the hole.

However, this conventional method for cleaning holes does not remove the above metal chips and burr completely. Although the reciprocated operations are repeated, they are still found thereon.

For example, as shown in FIG. 9, in somtime, when the burr left at projecting corner 3*a* of L-shape hole 3 and the fine metal chips remain in concave corner 3*b*, the burr or the fine metal chips could not be removed, because the brush 1 could not reach the projecting corner 3*a* or the concave corner 3*b*.

Also, cleaning of a hole or a screw hole with bottom is extremely difficult for the conventional method. Further, by sweeping the brush 1 into the hole 3, abrasive particles are formed, and removal of particles is required.

As described above, the conventional method provides insufficient cleaning action for holes and low processing efficiency. As a result, the costs of finished products tend to increase, and quality of the products is not reliable. For example, each work piece differs in the shape of metal chips and amount of burr. Therefore, the final product quality after cleaning tends to fluctuate; in other words, it is difficult to obtain stable quality.

The issue of remaining metal chips and burr is quite serious for the inner surface of dynamic pressure bearings which especially require cleanness. The incomplete cleaning of holes as described above may cause lower dynamic pressure characteristics and damage or burning of the dynamic pressure bearings; this may lead to a critical defect.

SUMMARY OF INVENTION

Therefore, the present invention intends to provide an apparatus and a method for cleaning holes in which a simple configuration provides prompt and excellent cleaning of holes. Also, the present invention intends to provide a method for cleaning in which the inner surface of dynamic pressure bearings is excellently cleaned.

According to an aspect of the present invention, there is provided an apparatus for forming holes comprising:

processing means including ultrasonic processing means for providing ultrasonic cleaning action to an inner wall of a hole formed on a work piece and electrolytic processing means for providing electrolytic cleaning action to said hole;

a cleaning tank for storing a cleaning fluid, which is used as a processing fluid for ultrasonic processing and a processing fluid for electrolytic processing, said work piece being immersed in said cleaning fluid;

a horn electrode tool serving as a horn tool for said ultrasonic processing means and an electrode tool for said electrolytic processing means; and a support means supporting said horn electrode tool movable forward or backward in relation to said hole formed on said work piece in said cleaning tank.

DETAILED DESCRIPTION OF PREFERRED EMBODIMENTS

The following describes an embodiment of the present invention in relation to drawings.

Figure 1:
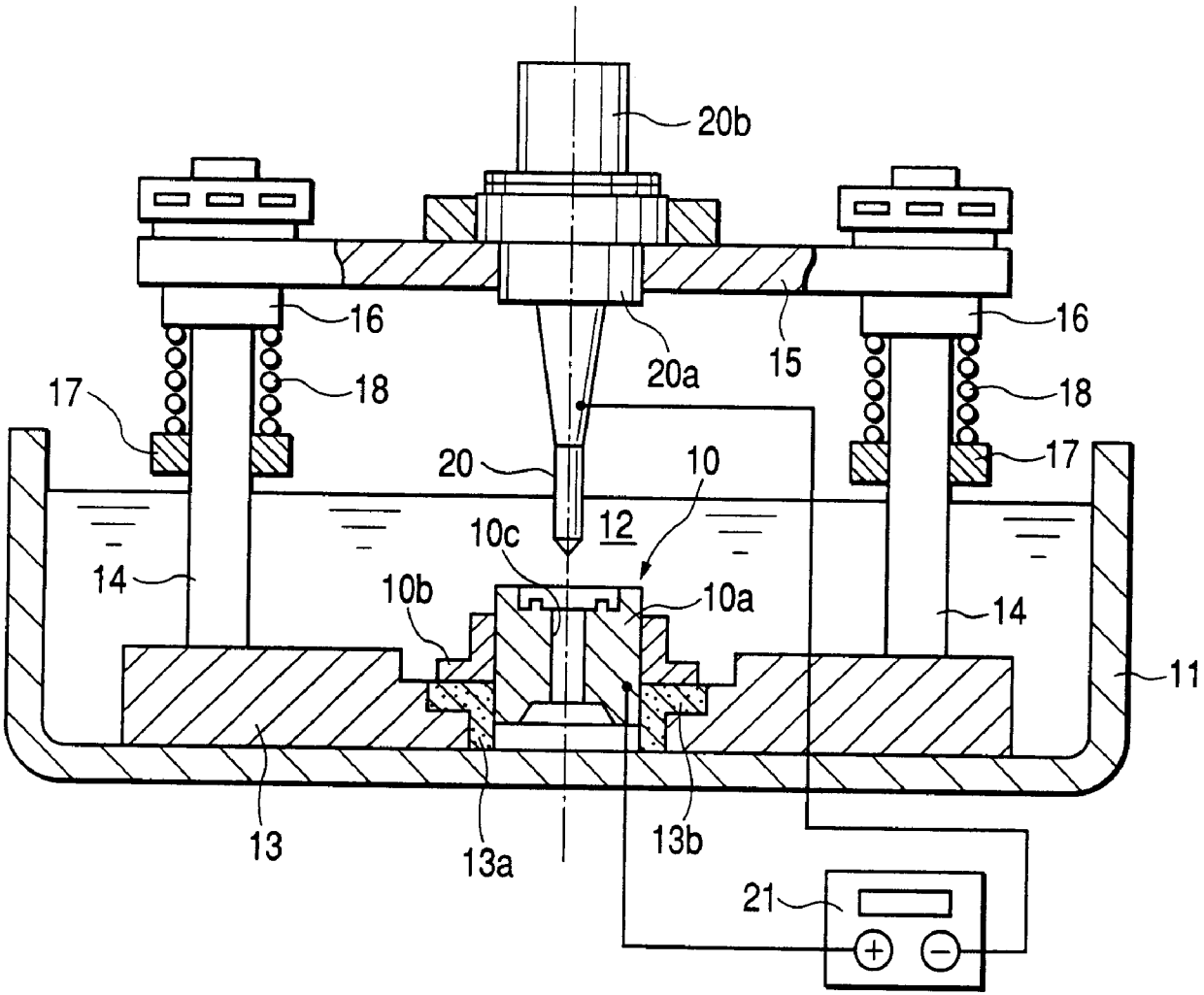
FIG. 1 is a cross section showing a schematic configuration of an apparatus for forming holes for dynamic pressure bearings according to an embodiment of the present invention.

Dynamic pressure bearing 10 is used as a work piece in an apparatus for forming holes of this embodiment shown in FIG. 1. In recent years, a dynamic pressure bearing apparatus having dynamic pressure bearing 10 is employed to hold various rotating bodies, such as polygon mirrors, magnetic discs, and optical discs, which rotate at high speed. Therein, the dynamic pressure surface on the shaft member side and the dynamic pressure surface on the bearing member side are annularly placed facing each other with a small space in the radial direction. Pressure is applied to a lubricating fluid, such as air or oil, placed in the small space, by pumping action of a dynamic pressure generating means during rotation. Consequently, the shaft member and the bearing member are supported rotatable to each other by dynamic pressure of the lubricating fluid.

A dynamic pressure bearing 10 as a work piece includes a bearing portion 10*a* formed of an approximately cylindrical SUS member and a housing 10*b* formed by an aluminum member in a flange shaped, which is assembled to the outer circumference of the bearing portion 10*a*. The whole body of the dynamic pressure bearing 10 is immersed in the cleaning fluid 12 stored in the cleaning tank 11. The cleaning fluid 12 is defined by a mixture of water, a surfactant for propagation of ultrasonic waves and an electrolyte for electrolytic processing such that it can be used as both a processing fluid for ultrasonic processing and a processing fluid for electrolytic processing. Possible combinations include 0.03 to 1 weight % synthetic detergent or surfactant added to an electrolyte containing 10 to 30 weight % sodium nitrate ($NaNO_3$), 3 to 10 volume % synthetic detergent or surfactant added to the water, or a given electrolyte mixed with a surfactant solution; in either case, the concentration of the electrolyte is established to be within a range of 5 to 30 weight %.

Dynamic pressure bearing 10 placed in the cleaning tank 11 as a work piece is engaged into an assembly hole 13*a* of a fixed support plate 13 formed of a plate-shaped SUS member or aluminum member, which is horizontally placed inside the cleaning tank 11. The axial direction a hole 10*c*, which is mechanically formed at the center of bearing portion 10*a*, is positioned in vertical while fixing the dynamic pressure bearing 10 to the cleaning tank 11.

Also, an insulator 13*b* formed of an engineering plastic or the like is embedded at the area defined from the inner wall of the assembly hole 13*a* of the fixed support plate 13 to the circumference of the upper open end, and the insulator 13*b* insulates between the bearing portion 10*a* and the housing 10*b*, and the fixed support plate 13.

Additionally, a pair of guide bars 14, 14 are elected from the upper surface of fixed support plate 13 in such a manner that the dynamic pressure bearing 10 is interposed between the guide bars 14, 14. On the top end of the each guide bar 14, a movable support plate 15 is placed via bushing 16 such that the movable support plate 15 can slide vertically along an axis of the guide bar 14. Also, an annular support collar 17 is fixed to the portion of each guide bar 14 in such a manner that the annular support collar 17 is positioned above the surface of the cleaning fluid 12. The movable support plate 15 is placed such that upward force is applied from support collar 17 via coil spring 18 receives urging force generated by the coil spring 18 in an upper direction with respect to each annular support collar 17.

A cylindrical body 20*a* supporting the horn electrode tool 20 is fixed to the approximate center of the movable support plate 15. The horn electrode tool 20 is formed of a rod member to be serving as a horn tool for ultrasonic processing and/or as an electrode tool for electrolytic processing. The horn electrode tool 20 is assembled such that the horn electrode 20 extends vertically downwardly from the bottom of cylindrical body 20*a*. The horn electrode tool 20 is concentrically positioned with respect to the axis of a processed hole 10*c* of the dynamic pressure bearing 10 as a work piece. Also, the outside diameter of the horn electrode tool 20 (ϕ4.00 mm) is established to be smaller than the inside diameter of the processed hole 10*c* of the dynamic pressure bearing 10 by 0.5 mm of the radius. Therefore, the horn electrode tool 20 can be freely inserted into or slid out from the hole 10*c* of the dynamic pressure bearing 10.

Additionally, an ultrasonic wave generating portion 20*b* employing high voltage is connected to the upper surface of cylindrical body 20*a* to form an ultrasonic processing means. Vibration energy generated from the ultrasonic wave generating portion 20*b* is amplified by the horn electrode tool 20 and is propagated to the cleaning fluid 12. The frequency of the vibration energy generated by ultrasonic wave generating portion 20*b* is established within a range of 10 to 100 kHz, more preferably, 10 to 35 kHz.

As mentioned above, the horn electrode tool 20 functions as a horn tool for the ultrasonic processing means as well as a processing electrode for the electrolytic processing means. In other words, positive 5V to 20V voltage is applied to the horn electrode tool 20 from a power supply means 21 via a terminal (not shown). As a result, the dynamic pressure bearing 10, specifically, the surface of the inner wall of hole 10*c* on dynamic pressure bearing 10, is dissolved in an extremely small amount with respect to the proportional relationship between the cleaning fluid 12 and the electrolytic cleaning The lower tip end of horn electrode tool 20, which faces hole 10*c* of dynamic pressure bearing 10, is shaped as a spire with an about 90° apex to effectively generate the above mentioned ultrasonic vibration and the electrolytic energy.

The following describes an embodiment of a method for cleaning holes using such an apparatus for forming holes, which can be used as an ultrasonic processing means and/or as an electrolytic processing means.

As shown in FIG. 1,the lower end of dynamic pressure bearing 10 as a work piece, on which the processed holes 10*c* are mechanically formed, is engaged into the assembly hole 13*a* of the fixed support plate 13 to fix it therein. Then, dynamic pressure bearing 10 is completely immersed into cleaning fluid 12, which is used as a processing fluid for the ultrasonic processing and as a processing fluid for the electrolytic processing. Cleaning fluid 12 is, for example, 0.03 volume % synthetic detergent and 5 weight % sodium nitrate ($NaNO_3$) mixed into water.

Thereafter, positive electric potential and negative electric potential are applied to the dynamic pressure bearing 10 and the horn electrode tool 20, respectively. For example, 7V electrolytic voltage is applied through the cleaning fluid 12 while vibrations having 28 kHz ultrasonic waves is applied from the ultrasonic wave generating portion 20*b* to the horn electrode tool 20. Then, horn electrode tool 20 is slowly lowered. from the original waiting position such that the ultrasonic cleaning action and the electrolytic cleaning action are subjected to the dynamic pressure bearing 10 via the horn electrode tool 20. While descending, the horn electrode tool 20 is vertically moved with a predetermined stroke to insert it into the hole 10*c* of the dynamic pressure bearing 10. For example, the vertical reciprocating movement of the horn electrode tool 20 is repeated in three times while the electrolytic voltage is applied over a period of 3 to 5 seconds per one movement.

As a result, the ultrasonic vibration, as well as the dissolving action subjected by the electrolytic processing, is directly propagated to the inner wall of the hole 10*c* of dynamic pressure bearing 10. Therefore, uneven surfaces, which cannot be directly reached by a conventional brush, can be cleaned to excellently remove metal chips, such as swarf and process particles, and burr.

In this embodiment, the ultrasonic vibration and electrolytic action are smoothly provided from the spiral end of the horn electrode tool 20 to the inside of hole 10*c*; hence, ultrasonic cleaning action and electrolytic cleaning action are effectively performed.

After subjecting a predetermined time of period of cleaning, the power source for the ultrasonic processing means and the electrolytic processing means is switched off. Then, horn electrode tool 20 is turned back to the original position to complete the operation.

When significantly adhesive burr may be removed, there is considered the countermeasure such as increasing the electrolytic voltage, increasing the electrolytic concentration of the cleaning fluid 12, extending the processing time or the like. Also, if a change in the inside diameter of hole 10*c* were to be minimized, there would be considered the countermeasure such as decreasing the electrolytic voltage, lowering the electrolytic concentration of the cleaning fluid 12, shortening the processing time while extending the time period for ultrasonic processing, enlarging the clearance of horn electrode tool 20 or the like.

The above embodiment of the present invention can be modified as below.

In the above embodiment, cleaning is performed while vertically reciprocating movement of the horn electrode tool 20. However, the horn electrode tool 20 may be held at a position where the horn electrode tool 20 is inserted in the hole 10*c* to a predetermined depth or is placed adjacent to the hole 10*c* during cleaning.

Figure 2A:
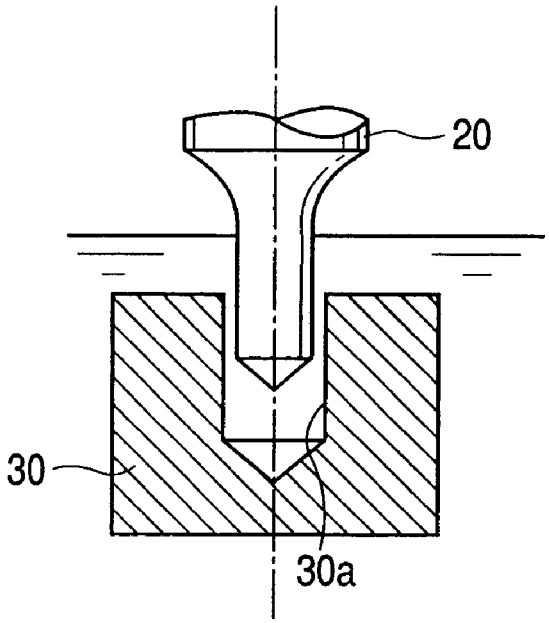
FIG. 2(*a*) and (*b*) are cross sections showing an enlarged end of a horn electrode tool.
Figure 2B:
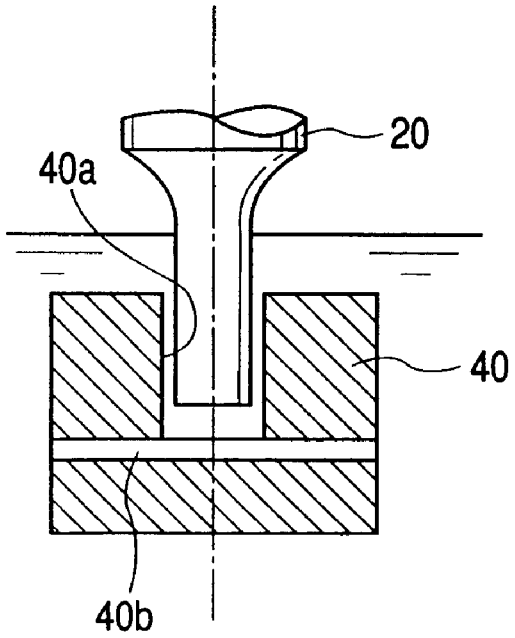
Figure 3A:
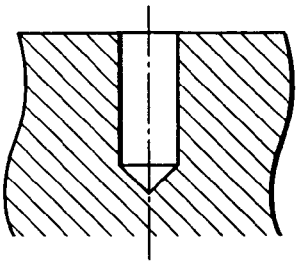
FIGS. 3(*a*) to (*h*) are cross sections showing various modes of holes to which the present invention is applicable.
Figure 3B:
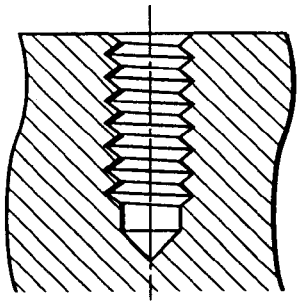
Figure 3C:
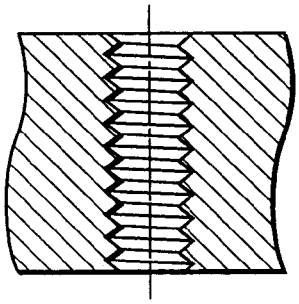
Figure 3D:
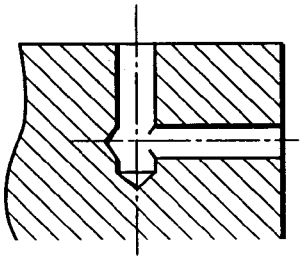
Figure 3E:
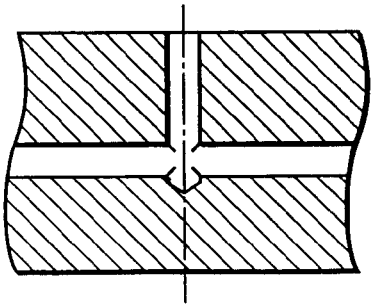
Figure 3F:
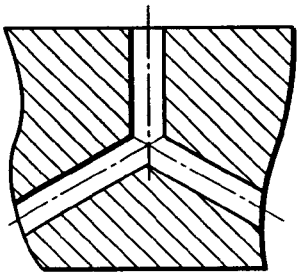
Figure 3G:
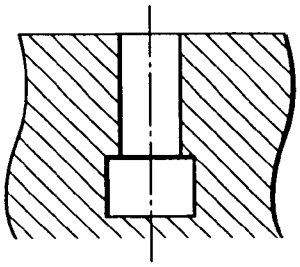
Figure 3H:
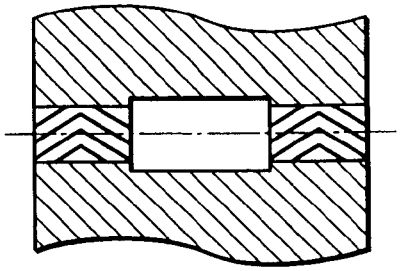

The tip end of the horn electrode tool 20 in the above embodiment is shaped as a spire. Such shape is especially effective for the hole 30*a* of the work piece 30, as shown in FIG. 2(*a*), having the bottom shape of the hole which is spirally depressed to meet the tip end of the horn electrode tool 20. However, when another hole 40*b* is formed perpendicular to the bottom end of the hole 40*a* of the work piece 40 as shown in FIG. 2(*b*), it is preferable to form the tip end of horn electrode tool 20 to be a plane surface.

Further, a work piece used in the present invention is not limited to the dynamic pressure bearing 10 of the above embodiment; the present invention is applicable to the holes formed on work pieces of various configurations and shapes. The present invention provides excellent results especially to holes which would be difficult to clean with a conventional brush, as shown in FIGS. 3(*a*) through (*h*), such as a hole with a small diameter (ϕ1 to 3 mm), a hole with a closed end, and a threaded hole.

FIG. 3(*a*) shows a hole with a small diameter and a closed end. FIG. 3(*b*) shows a tapped hole with a small diameter and a closed end. FIG. 3(*c*) shows a tapped through-hole with a small diameter. FIG. 3(*d*) shows an L-shaped hole with a small diameter. FIG. 3(*e*) shows a T-shaped hole with a small diameter. FIG. 3(*f*) shows an angled T-shaped hole with a small diameter. FIG. 3 (*g*) shows a blind necking hole with a small diameter. FIG. 3 (*h*) shows a dynamic pressure group bearing hole with a small diameter.

The following describes another embodiment according to the present invention in reference to FIGS. 4 through 8.

Figure 4:
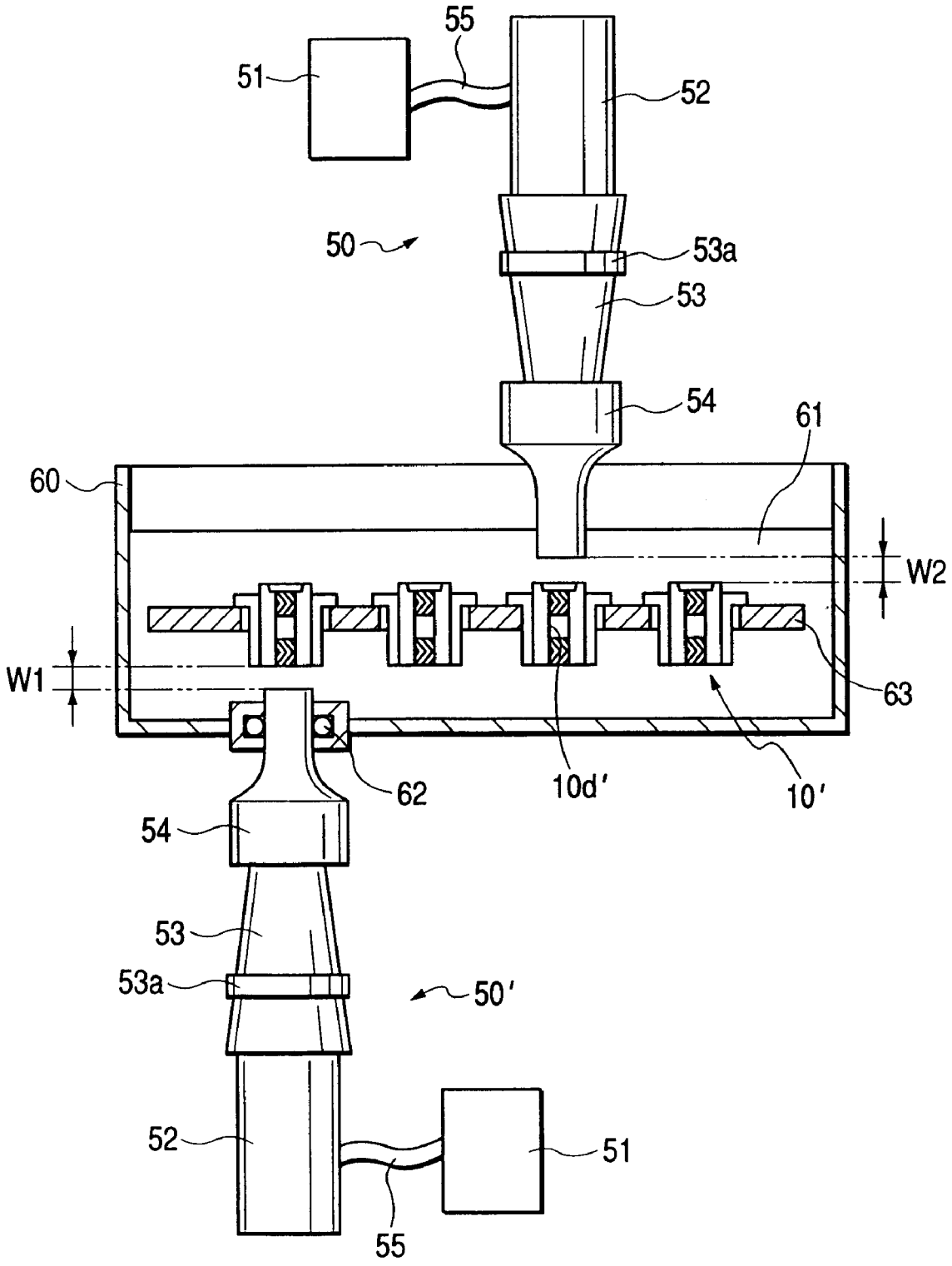
FIG. 4 is a cross section showing an ultrasonic cleaning apparatus employed for a cleaning method in an embodiment of the present invention.

FIG. 4 shows an ultrasonic cleaning apparatus according to a cleaning method of the present invention. The ultrasonic cleaning apparatus shown in FIG. 4 mainly includes a cleaning tank 60 storing cleaning fluid 61 and ultrasonic wave applying means 50. The ultrasonic wave applying means 50 is equivalent to the horn electrode tool 20 in FIG. 1. The cleaning fluid 61 is a water solution in which 0.001% to 0.1% surfactant, such as a synthetic detergent, or a cleaning agent with dissolving/dispersing power is dissolved in tap water as a main ingredient thereof. A support plate 63 having a plurality of through holes is placed in the cleaning fluid 61; A dynamic pressure bearing 10' as a work piece is loosely inserted in each of the through holes. These dynamic pressure bearings 10' are held such that their height in the horizontal direction is approximately equal.

Figure 5:
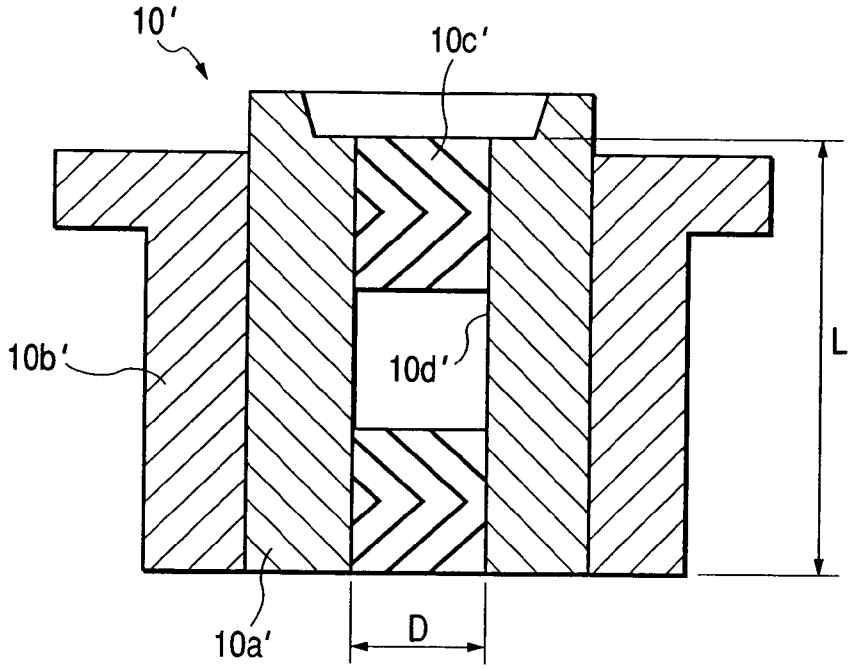
FIG. 5 is a cross section showing a dynamic pressure bearing to be cleaned in an embodiment of the present invention.

FIG. 5 is a cross section of the dynamic pressure bearing 10' to be cleaned in this embodiment. The dynamic pressure bearing 10' includes a housing 10*b*' formed of aluminum alloy and the like and a cylindrical bearing portion 10*a*' formed of SUS or the like, which is fixed and secured to housing 10*b*'. A bearing hole 10*d*' pierces through the center of bearing portion 10*a*'. Dynamic pressure generating grooves 10*c*' shaped as herring bones are formed on the inner surface of the bearing hole 10*d*' with a space therebetween in the axial direction by rolling and etching. Also, inside diameter D of the bearing hole 10*d*' and length L of the bearing hole 10*d*' are established within a range of about 3 mm to 10 mm and 10 mm to 50 mm, respectively. Foreign objects such as process particles and cutting oil generated during processing (not shown in the figure) are adhered to the inner and outer surfaces and both end surfaces of the bearing hole 10*d*' of dynamic pressure bearing 10. These foreign objects are removed by the cleaning means described later.

Returning to FIG. 4, the ultrasonic wave applying means 50 includes an ultrasonic wave generator 51, an oscillator 52 connected to the ultrasonic wave generator 51 via a cable 55, a cone 53 connected to the oscillator 52; and a horn 54 having one end connected to the cone 53 and another immersed in the cleaning fluid 61. The embodiment shown in FIG. 4 employs two ultrasonic wave applying means 50, 50'. In other words, one ultrasonic wave applying means 50 stands above the cleaning tank 60 with the horn 54 facing toward the cleaning fluid 61 while another ultrasonic wave applying means 50' has the end of the horn 54 projecting into the cleaning fluid 61 via the annular sealing means 62 placed at the bottom of the cleaning tank 60. These ultrasonic wave applying means 50, 50' are firmly fixed with respect to the cleaning tank 60; however, the upper ultrasonic wave applying means can be established to be horizontally movable.

The oscillator 52 is formed of a piezoelectric material or the like. The oscillator 52 converts ultrasonic electric signals, which have a frequency between 10 kHz and 100 kHz and which are generated by the ultrasonic generator 51, into vibration energy. The cone 53 is fixed to a body of the apparatus (not shown in the figure) via the flange 53*a* to amplify the vibration energy to a predetermined amplitude. The horn 54 is formed of a material with low vibration damping characteristic, such as a metal, to further amplify the vibration energy amplified by the cone 53 and to propagate it to the cleaning fluid 21.

The vibration energy propagated to the cleaning fluid 61 is further propagated to the dynamic pressure bearing 10' immersed in cleaning fluid 61. Then, the ultrasonic vibration is generated in the dynamic pressure bearing 10' such that relative motion is generated between dynamic pressure bearing 10' and cleaning fluid 61. This relative motion causes vigorous friction on the phase boundary of the dynamic pressure bearing 10' and the cleaning fluid 61; as a result, foreign objects on the surface of the dynamic pressure bearing 10' are removed.

The following describes a method for cleaning the dynamic pressure bearing 10' using the above ultrasonic cleaning apparatus.

First, as shown in FIG. 4, a plurality of dynamic pressure bearings 10' are placed on support plate in the cleaning tank 60 storing the cleaning fluid 61. The open ends of bearing hole 10*e*' of the dynamic pressure bearings 10' are directed almost vertical. Herein, since the support plate 63 is shaped as a plane substrate, the dynamic pressure bearings 10' are placed to be flush with the same height in the horizontal direction. Additionally, the positions of a pair of the ultrasonic wave applying means 50, 50' and the support plate 63 is established in advance such that a distance W1 defined between the bottom surface of the dynamic pressure bearings 10' supported by the support plate 63 and the lower horn 54 and distance W2 defined between the top surface of the dynamic pressure bearings 10' and the upper horn 54 are less than 15 mm.

When the distance between the end of each horn 54 and the end surface of the dynamic pressure bearing 10' is less than 15 mm, a desired cleaning effect will be obtained. However, if the two objects come too close and contact each other, mechanical noise is caused and the two objects may be damaged by metal contact; therefore, it is preferable to maintain the distance therebetween at 5 mm to 15 mm. Also, the support plate 63 is horizontally movable driven by a drive (not shown in the figure) in the above embodiment. When the drive is activated after placing a predetermined number of the dynamic pressure bearings 10' on the support plate 63, the support plate 63 moves in the horizontal direction while maintaining the vertical distance between the horn 54 and the dynamic pressure bearing 10' within 5 mm and 15 mm. Thereafter, The cleaning fluid 61 is vibrated by activating the ultrasonic wave applying means 50. However, this operation may be performed prior to the movement of the support plate 63 which supports the dynamic pressure bearings 10'. The ultrasonic vibration generated by activation of the ultrasonic wave applying means 50 is propagated to the dynamic pressure bearings 10' via the cleaning fluid 61. Here, ultrasonic vibration is caused in the dynamic pressure bearings 10' to evoke relative motion between the surface of the dynamic pressure bearings 10' and the cleaning fluid 61. This relative motion causes friction on the phase boundary of the dynamic pressure bearing 10' and the cleaning fluid 61. As a result, foreign objects on the surface of the dynamic pressure bearing 10' are removed. Also, the open ends of the dynamic pressure bearings 10' are directed in the vertical direction and face the horn 54 of ultrasonic wave applying means 50 with a distance between 5 mm and 15 mm; therefore, the ultrasonic vibration is propagated along the inner wall of the bearing hole **10*d'*** towards the open ends without seriously damping.

Since the cleaning fluid 61 contains a surfactant or a synthetic detergent with dissolving/dispersing power, the surface tension of the cleaning fluid 61 is decreased. As a result, the cleaning fluid 61 ensurely reaches the bottom of the dynamic pressure generating grooves **10*c'* with a depth of several $\mu$m. Therefore,the present invention can provide precise cleaning of the dynamic pressure generating grooves 10*c'***.

The vibration time period preferably sets preferably within 10 to 60 seconds per piece under the condition the ultrasonic wave application means 50 is placed close to dynamic pressure bearing 10'. In other words, about 60 seconds of vibration time can almost completely remove foreign objects from the surface of the bearing, whereas the vibration time less than 10 seconds may not provide a sufficient cleaning level, which is defined as a number of foreign objects more than 300 pieces/cm$^2$. Additionally, as long as the vibration time of period, in the case where the ultrasonic vibration is subjected in the condition of adjacently confronting the ultrasonic wave applying means 50 with the dynamic pressure bearing 10', if the time of period for confronting the ultrasonic wave applying means 50 and the dynamic pressure bearing 10' is within 10 to 60 seconds, the number of foreign objects can be suppressed regardless fact of the motion condition or the stable condition of the supporting plate 63 for supporting the dynamic pressure bearing 10'.

Further, when length L of the bearing hole **10*d'* of the dynamic pressure bearing 10' (see FIG. 5) is longer than double of inside diameter D of the bearing hole 10*d'*, that is, L/D>2, ultrasonic waves are provided from both open ends of the dynamic pressure bearings 10' by placing the ultrasonic wave applying means 50, 50' thereat as shown in the cleaning apparatus of FIG. 4. As a result, foreign objects adhered inside the bearing hole 10*d'* can be precisely removed in a short time of period. When the dynamic pressure bearings 10 of the above configuration are cleaned, the same cleaning level may result by providing ultrasonic waves from the ultrasonic wave applying means 50 from one open end of dynamic pressure bearing 10 and repeating application of ultrasonic wave after turning dynamic pressure bearing 10'** by 180 degrees.

On the other hand, when length L of the bearing hole **10*d'* of the dynamic pressure bearing 10 is less than double of inside diameter D of the bearing hole 10*d*, that is, L/D≦2, ultrasonic waves are provided from one open end of the dynamic pressure bearing 10 by placing the ultrasonic wave applying means 50** thereat. In this case, a desired level of cleaning can be obtained by providing vibration from one end due to the relatively short length L.

After completing the set of cleaning processes as described above, dynamic pressure bearings 10' are removed from support plate 63. Then, the number of foreign objects remaining on the surface of each cleaned dynamic pressure bearing 10 was measured to be less than 300 pieces/cm$^2$according to the present embodiment. Therefore, it is concluded that the level of cleaning is remarkably improved by cleaning for a short time of period as compared with that of the conventional cleaning method. Also, the cleaning fluid 61 has sufficient cleaning characteristic by simply dissolving a surfactant in tap water; hence, the running costs can be reduced. Furthermore, the configuration of the cleaning apparatus can be simplified while the cleaning process can be partially automated; consequently, productivity can be improved.

Figure 6:
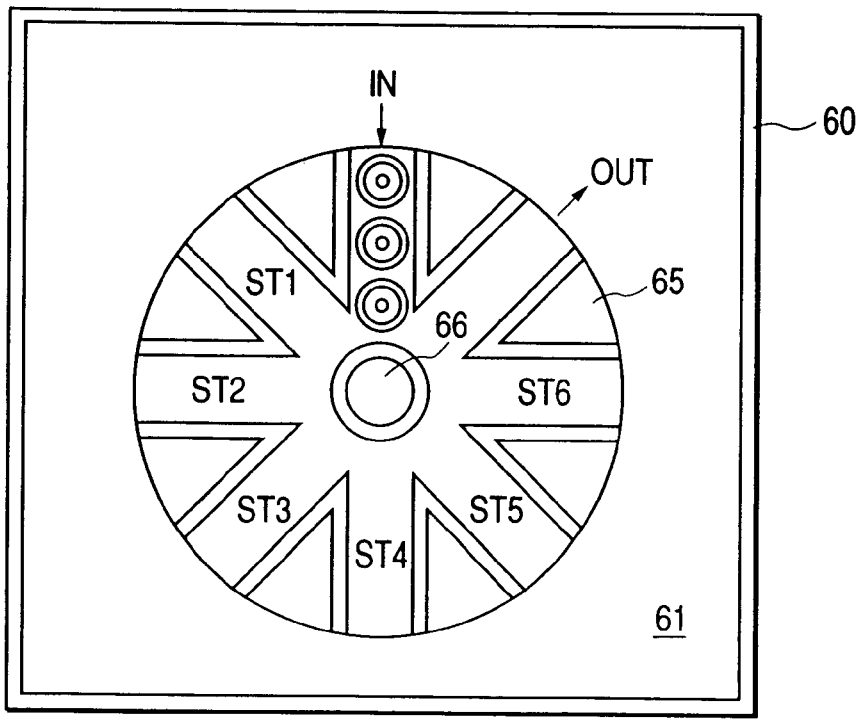
FIG. 6 is a plan view showing an ultrasonic cleaning apparatus employed for a cleaning method in another embodiment of the present invention.
Figure 7:
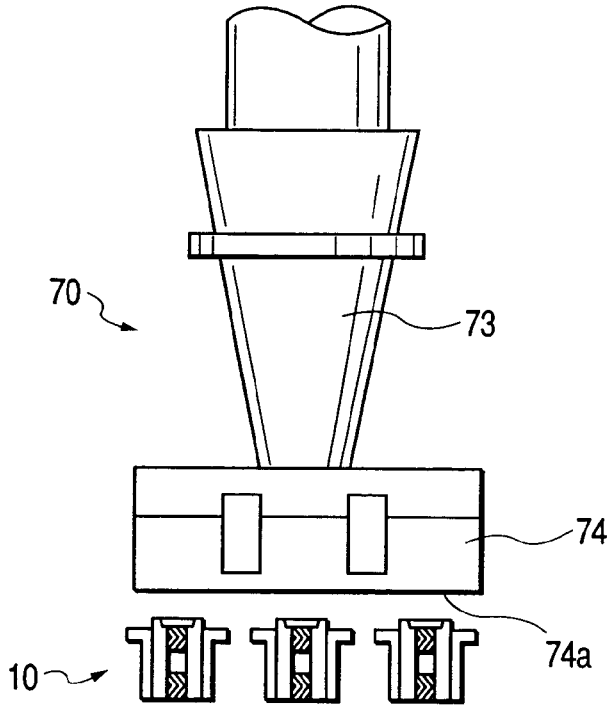
FIG. 7 is an enlarged view of a major part of an ultrasonic wave applying means employed for a cleaning method in another embodiment of the present invention.
Figure 9:
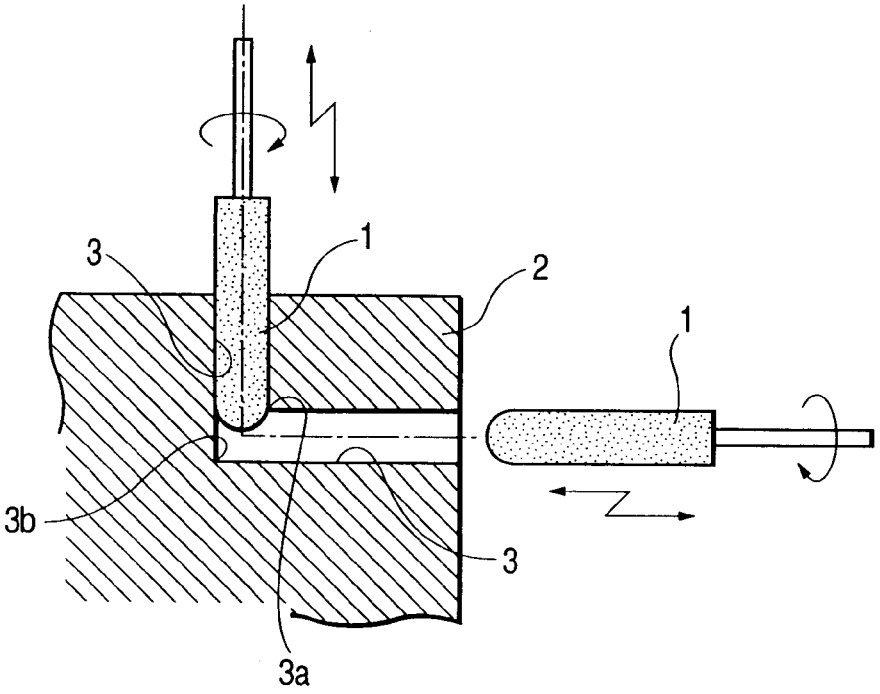
FIG. 9 Prior Art
FIG. 9 is a side view showing a conventional method of brush cleaning.

The following describes another embodiment of a method for cleaning dynamic pressure bearings according to the present invention. FIG. 6 is a plan view schematically showing a cleaning apparatus. FIG. 7 is a side view of an enlarged major part of ultrasonic wave applying means 70 used in the above cleaning apparatus. In FIG. 6, a support plate 65 includes eight lanes which are radially formed on meshed base portion thereof; also, it is rotatable around shaft 66 in the cleaning tank 60 storing the cleaning fluid 61. The eight lanes include, in order from an inlet IN, first state ST1, second stage ST2, third stage ST3, fourth stage ST4, fifth stage ST5, sixth stage ST6 and an outlet in a counterclockwise direction. Each lane has a space for holding a plurality of the dynamic pressure bearings. Also, as shown in FIG. 7, the ultrasonic wave application means 70 is placed above each of the odd-numbered stages ST1, ST3 and ST5 (an upper side in view of the vertical direction of the sheet), whereas the ultrasonic wave applying means 70 are placed below each of the even-numbered stages ST2, ST4 and ST6 (a lower side in view of the vertical direction of the sheet).

As shown in FIG. 7, the ultrasonic wave applying means 70 has a configuration almost identical to ultrasonic wave applying means 50 shown in FIG. 4; except, the shape of the horn 74 is different in the end shape from the cone 73. The horn 74 is enlarged in the width direction (horizontal direction) such that an end surface **74*a* has an area large enough to face a plurality of dynamic pressure bearings 10 at once. The ultrasonic wave applying means 70 are placed above or below dynamic pressure bearings 10** with a space between 5 mm and 15 mm.

When a plurality, for example three, of the dynamic pressure bearings 10 are placed from the inlet IN of the support plate 65 shown in FIG. 6, the support plate 65 rotates counterclockwise direction around the shaft 66 at a low speed via a drive (not shown in the figure). Then, the dynamic pressure bearings 10 placed at the inlet IN are eventually moved to the first stage ST1. Here, each of the dynamic pressure bearings 10 is irradiated with ultrasonic waves from the ultrasonic wave applying means 70 which is placed above ST1. When the dynamic bearings 10 originally placed shift to the first stage ST1, several more dynamic pressure bearings 10 are placed from the inlet IN. With rotation of the support plate 65, the dynamic pressure bearings 10 originally placed shift to the second stage ST2, and a second set of the dynamic pressure bearings 10 shift to first stage ST1. Then, ultrasonic waves are irradiated to the dynamic pressure bearings 10 at the second stage ST2 from the ultrasonic wave applying means 70 which is located thereunder; also, ultrasonic waves are irradiated to the dynamic pressure bearings 10 at the first stage ST1 from the ultrasonic wave applying means 70 which is located thereabove. Since the base portion is formed as a mesh, the dynamic pressure bearings 10 positioned at second stage ST2 receive ultrasonic waves from the ultrasonic wave applying means 70 thereunder without any interference. Also, the dynamic pressure bearings 10 at second stage ST2 are already irradiated with ultrasonic waves at the first stage ST1 from the upper side so that they receive ultrasonic waves from both open ends of bearing holes 10*d* as they go through ST2.

As described above, the dynamic pressure bearings 10 are successively supplied to a lane which shifts into the position of the inlet IN with rotation of the supply plate 65. The original set of the dynamic pressure bearings 10 receive ultrasonic waves from the above again at the third stage ST3, after the first stage ST1. They receive ultrasonic waves from below again at the fourth stage ST4. Then, they receive ultrasonic waves from above for the third time at the fifth stage ST5. At last, they receive ultrasonic waves from below for the third time at the sixth stage ST6. Thereafter, they reach outlet OUT and are removed from support plate 65.

According to the above cleaning method, ultrasonic waves are irradiated to dynamic pressure bearings 10 from both sides of their open ends for a plurality of times such that foreign objects adhered to dynamic pressure bearings 10 can be precisely removed in a short time of period. The number of lanes formed on support plate 65 is not limited to one as in the above embodiment but can be modified to an arbitrary number. Also, the above describes an embodiment employing the ultrasonic wave applying means 70 including the horn 74 which is large enough to face a plurality of the dynamic pressure bearings 10; however, the cleaning operation may be performed by using the ultrasonic wave applying means 50 shown in FIG. 4. In this case, the ultrasonic wave applying means 50 is placed such that the ultrasonic wave applying means 50 can slide with respect to the radial direction of the support plate 65 to irradiate ultrasonic waves to all dynamic pressure bearings 10 placed thereon.

Figure 8:
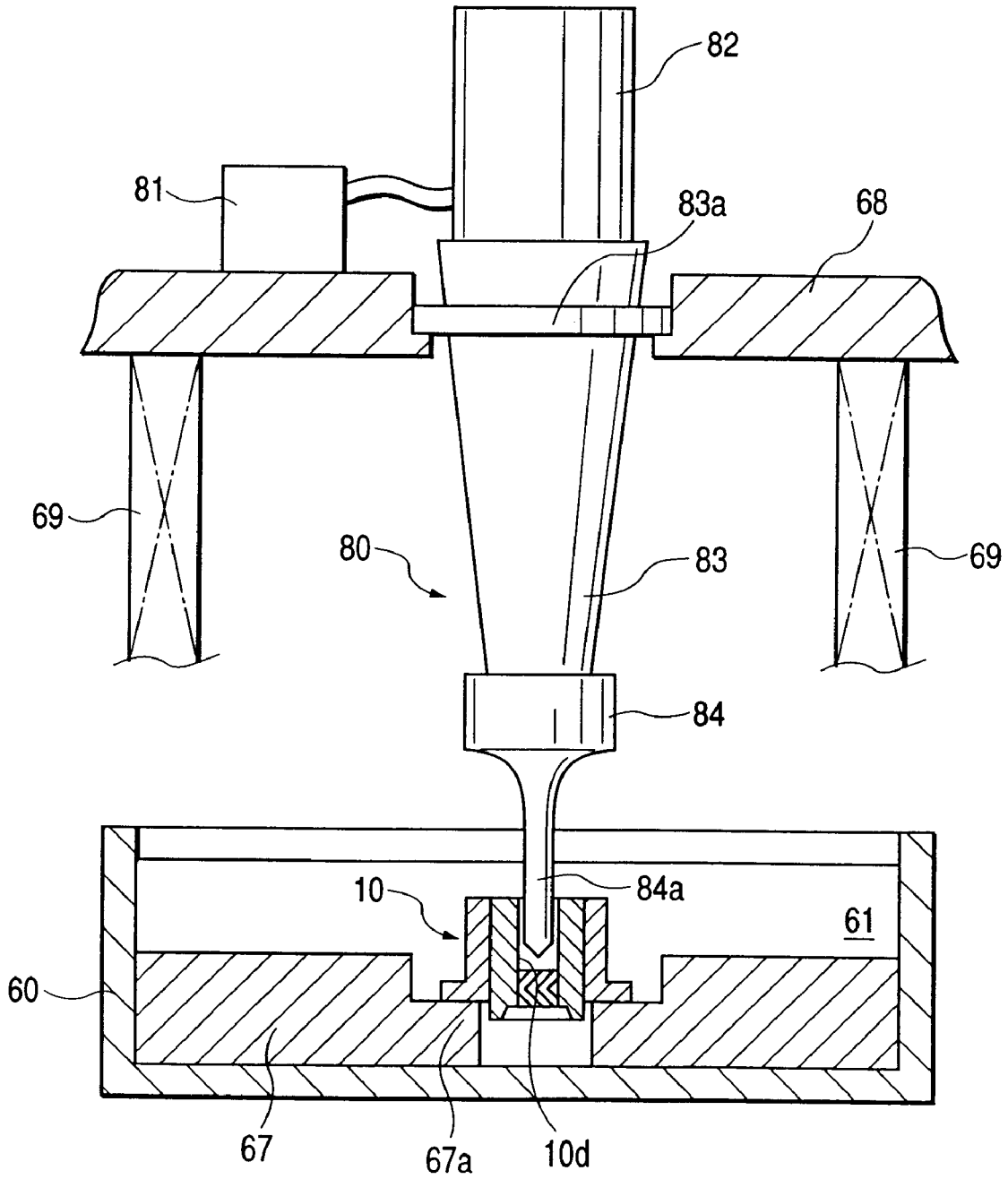
FIG. 8 is a cross section showing an ultrasonic cleaning apparatus employed for a cleaning method in yet another embodiment of the present invention.

The following describes another embodiment of the present invention in reference to FIG. 8. Since ultrasonic wave applying means 80 shown in FIG. 8 has a basic configuration identical to ultrasonic wave applying means 50 of FIG. 4, any redundant description will be omitted herein. The ultrasonic wave applying means 80 includes: an oscillator 82 which is connected to an ultrasonic wave generator 81; a cone 83 which amplifies vibration energy, that is, ultrasonic vibration generated in the oscillator 82; and a horn 84 which is connected to the cone 83. The horn 84 integrally includes an end portion 84*a* with an outside diameter which allows the insertion the horn 84 into the bearing hole 10*d* of the dynamic pressure bearing 10 to be cleaned. Also, the ultrasonic wave applying means 80 is fixed to support stage 68 formed above cleaning tank 60 via flange 83*a*. The support stage 68 is held by force transmission means 69 such as a coil spring to be vertically movable. Also, the bearing support stage 67 is formed at the bottom of the cleaning tank 60. A relative position of the ultrasonic wave applying means 80 and bearing support stage 67 is determined in advance such that when dynamic pressure bearing 10 is placed at support portion 67*a* of bearing support stage 67, an end portion 84*a* of the horn 84 can be inserted into the bearing hole 10*d* of the dynamic pressure bearing 10.

When the ultrasonic wave generator 81 of ultrasonic wave applying means 80 is activated, ultrasonic vibration, which is amplified by the cone 83, is propagated to the horn 84. After ultrasonic wave applying means 80 is lowered toward the cleaning fluid 61 against the force applied by force transmission means 69, the end portion 84*a* reaches the cleaning fluid 61 such that ultrasonic vibration is provided. When the ultrasonic wave applying means 80 is further lowered, the end portion 84*a* enters the bearing hole 10*d* to propagate ultrasonic vibration to the inner surface of the bearing hole 10*d*. In this case, the clearance between the inner surface of bearing hole 10*d* and the outer surface of the end portion 84*a* is 200 $\mu$m to several mm wherein ultrasonic vibration is directly propagated to the dynamic pressure generating grooves formed on the inner surface of the bearing hole 10*d*. Also, even when the end portion 84*a* is inserted into the bearing hole 10*d* for a short time of period, sufficient level of cleaning is provided. After applying vibration for a predetermined time of period, the ultrasonic wave applying means 80 is lift up by using the force of the force transmission means 69; then, the cleaned object is replaced with the next object to be cleaned. By repeating the above cleaning process, the dynamic pressure bearings can be cleaned highly precisely and effectively.

The above described embodiments of the present invention in detail. However, one shall not be limited to the above embodiments; various modifications are applicable within the scope of the present invention.

For example, support plate 63 in the embodiment shown in FIG. 4 is a plane; however, it can be shaped as a hook or a mesh as long as the dynamic pressure bearing 10 is maintained to have its open ends in the vertical direction. Also, instead of a mode such as the embodiment shown in FIG. 4 in such a manner that the support plate 63 is movable in the horizontal direction, the ultrasonic wave applying means 50 may be vibrated while moving in the horizontal direction. In other words, by moving the dynamic pressure bearing 10 and the ultrasonic wave applying means 50 are shifted in the horizontal direction relative to each other, ultrasonic waves are propagated to dynamic pressure bearing 10 from various directions such that the entire surface of dynamic pressure bearing 10 can be precisely cleaned.

What is claimed is:

1. An apparatus for processing holes comprising:

processing means including ultrasonic processing means for providing ultrasonic cleaning action to an inner wall of a hole formed on a work piece and electrolytic processing means for providing electrolytic cleaning action to said hole;

a cleaning tank for storing a cleaning fluid, which is used as a processing fluid for ultrasonic processing and a processing fluid for electrolytic processing, said work piece being immersed in said cleaning fluid;

a horn electrode tool serving as a horn tool for said ultrasonic processing means and an electrode tool for said electrolytic processing means; and a support means supporting said horn electrode tool movable forward or backward in relation to said hole formed on said work piece in said cleaning tank.

2. An apparatus for processing holes according to claim 1, wherein the end of said horn electrode tool facing said hole on said work piece is shaped as a spire.

3. An apparatus for processing holes according to claim 1, wherein said horn electrode tool is placed to be inserted into said hole on said work piece.

4. An apparatus for processing holes according to claim 1, wherein the frequency of ultrasonic waves generated by said ultrasonic processing means towards said horn electrode tool is established to be within a range of 10 to 100 kHz.

5. An apparatus for processing holes according to claim 1, further comprising:

a first electrode providing one of positive (+) and negative (−) electric potential to said horn electrode tool; and a second electrode providing electric potential opposite of the electric potential provided by said first electrode to said work piece.

6. An apparatus for processing holes according to claim 1, wherein said cleaning fluid is a mixture of water, a surfactant to propagate ultrasonic waves and an electrolyte for electrolytic processing.

7. An apparatus for processing holes comprising:

processing means including ultrasonic processing means for providing ultrasonic cleaning action to an inner wall of a hole formed on a work piece and electrolytic processing means for providing electrolytic cleaning action to said hole;

a cleaning tank for storing a cleaning fluid, which is used as a processing fluid for ultrasonic processing and a processing fluid for electrolytic processing, one of said dynamic pressure bearing member and said shaft member serving as a work piece being immersed in said cleaning fluid;

a horn electrode tool serving as a horn tool for said ultrasonic processing means and an electrode tool for said electrolytic processing means; and a support means supporting said horn electrode tool movable forward or backward in relation to said hole formed on said dynamic pressure bearing in said cleaning tank.

8. An apparatus for processing holes according to claim 7 wherein the end of said horn electrode tool f acing said hole on said work piece is shaped as a spire.

9. An apparatus for processing holes according to claim 7 wherein said horn electrode tool is placed to be inserted into said hole on said work piece.

10. An apparatus for processing holes according to claim 7 wherein the frequency of ultrasonic waves generated by said processing means toward said horn electrode tool is established to be within a range of 10 to 100 kHz.

11. An apparatus for processing holes according to claim 7 further comprising:

a first electrode providing one of positive (+) and negative (−) electric potential to said horn electrode tool; and a second electrode providing electric potential opposite of the electric potential provided by said first electrode to said work piece.

12. An apparatus for processing holes according to claim 7 wherein said cleaning fluid is a mixture of water, a surfactant to propagate ultrasonic waves and an electrolyte for electrolytic processing.

13. A method for processing holes in which ultrasonic processing action and electrolytic cleaning action are provided to the inner wall of a hole formed on a work piece by using an apparatus for subjecting an ultrasonic processing and an electrolytic cleaning process, comprising the steps of:

immersing said work piece having holes into a cleaning fluid, which is used as a processing fluid for ultrasonic processing and a processing fluid for electrolytic processing; and moving a horn electrode tool in forwardly and backwardly in relation to said hole formed on said work piece, said horn electrode tool serving as a horn tool for said ultrasonic processing and an electrode tool for said electrolytic processing.

14. A method for processing holes according to claim 13 wherein said horn electrode tool is moved forward or backward in relation to said hole which is processed by providing one of positive (+) and negative (−) electric potential and ultrasonic waves to said horn electrode tool, and said work piece receives electric potential which is opposite from the electric potential provided to said horn electrode tool.

15. A method for processing holes according to claim 13 in which said work piece is cleaned by inserting said horn electrode tool into a hole formed on said work piece.

* * * * *